United States Patent [19]

Piro

[11] Patent Number: 4,608,967

[45] Date of Patent: Sep. 2, 1986

[54] PAT ON THE BACK APPARATUS

[76] Inventor: Ralph R. Piro, 676 Centre Ave., Lindenhurst, N.Y. 11757

[21] Appl. No.: 739,669

[22] Filed: May 31, 1985

[51] Int. Cl.[4] ..... A61H 7/00

[52] U.S. Cl. ..... 128/61; 4/559; 15/143 R; 15/210 R; 224/265; 269/3; 272/1 R; 272/76; 446/26; 128/67

[58] Field of Search ..... 128/24.2, 24 R, 24 A, 128/25 B, 28, 32–40, 45, 46, 47, 50–53, 56, 57, 59, 61, 62, 65, 66, 67; 272/96, 8 N, 8 R, 76, 27 R, 27 N, 1 R; 15/28, 29, 210 R, 143 R, 144 R, 145; 4/559; 2/44, 45; 269/3; 224/265; 446/26, 28

[56] References Cited

U.S. PATENT DOCUMENTS

| | | | |
|---|---|---|---|
| 1,537,464 | 5/1925 | Hummel | 128/65 |
| 1,999,799 | 4/1935 | Beck | 4/559 |
| 2,168,975 | 8/1939 | Clarke | 128/62 R |
| 2,642,863 | 6/1953 | Gordon | 128/38 |
| 3,679,107 | 7/1972 | Perrine | 224/265 |
| 3,856,002 | 12/1974 | Matsumoto | 128/62 R |
| 3,881,470 | 5/1975 | Glore | 128/55 |
| 4,266,536 | 5/1981 | Casares | 128/57 |
| 4,411,421 | 10/1983 | Hershberger | 128/57 |

FOREIGN PATENT DOCUMENTS

| | | | |
|---|---|---|---|
| 2527295 | 11/1977 | Fed. Rep. of Germany | 224/265 |
| 603405 | 1/1926 | France | 272/1 R |
| 36643 | 10/1935 | Netherlands | 224/265 |
| 21411 | 5/1900 | Switzerland | 128/62 R |

*Primary Examiner*—Clyde I. Coughenour
*Attorney, Agent, or Firm*—John J. Byrne; Bradford E. Kile; Kevin M. O'Brien

[57] ABSTRACT

A self-congratulatory apparatus having a simulated human hand carried on a pivoting arm suspended form shoulder supported member. The hand is manually swingable into and out of contact with the user's back to give an amusing or an important pat-on-the-back.

4 Claims, 2 Drawing Figures

FIG. 1
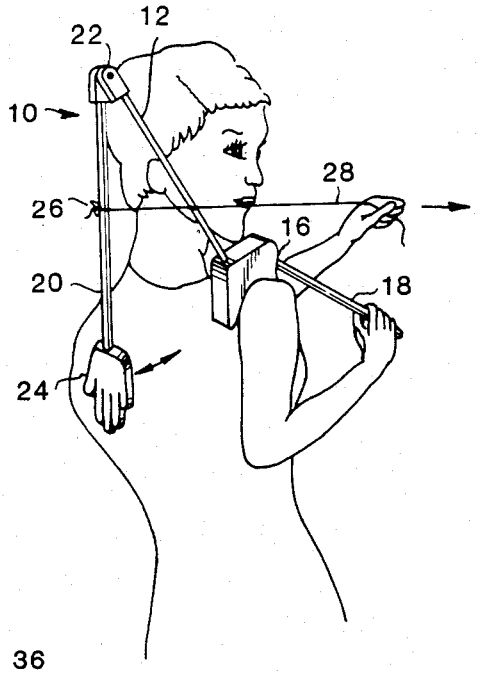
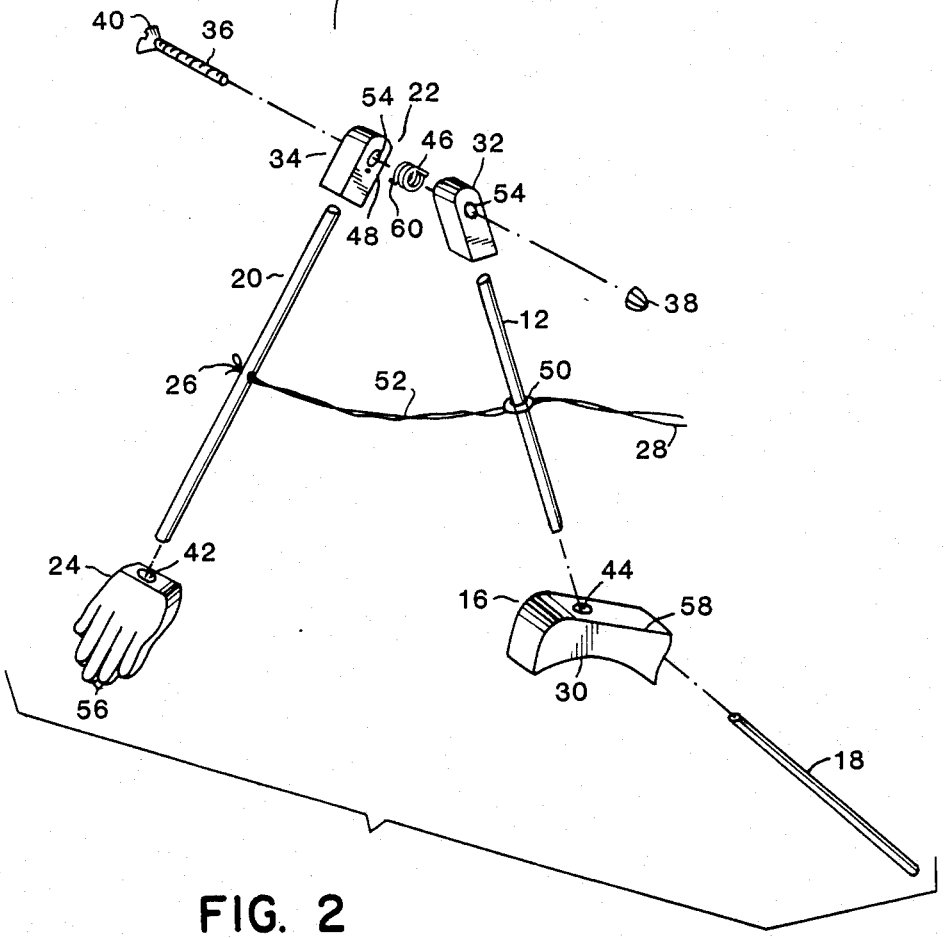
FIG. 2

PAT ON THE BACK APPARATUS

BACKGROUND OF THE INVENTION

This invention relates to an apparatus which is useful for providing a self-administered pat-on-the-back or a congratulatory gesture.

More particularly, this invention relates to an easily disassembled, portable and body mounted device which may be used for amusement or for a needed psychological lift. In this connection, an arrangement of easily manufactured pieces is assembled in tinker-toy fashion to set up a mechanical apparatus which employs either gravity or a spring biased mechanism to retract a simulated hand mounted on an arm from a body contacting position after urging to such a position by a ribbon or rope connection pulled by the user.

The present invention is relatively simple to assemble and operate and may be utilized by either a child or adult. One such usage is as an amusement or entertainment device which may be enjoyed either alone or in the presence of a group of persons. In this regard, the present invention is particularly suitable as a humorous gift to an employee or family member or as a party favor.

On the other hand, the device of the present invention may also be utilized to impart significant psychological benefits to the user. In this connection, it is well known in the art and practice of self-administered positive reinforcement activity that various techniques can be successfully employed to extol the virtues of one's actions and thoughts. For example, it has been reported that many wealthy and successful individuals engage in conversations with themselves, that is, they talk to themselves. Such an activity is understandable in view of the often small populace of self-motiviated individuals and in view of the large volume of self-defeatist conversation known to emanate from those of low self esteem. Another type of this activity is that of using mirrors to add visual impact and impression to that of the above mentioned voice feedback techniques.

Recent developments in psychological development techniques point to the need to have an abundance of behavior modification techniques available for the individual who seeks to reach more of the potential which scientists, spiritual leaders, and personal observation teach is attainable. Historically, much of the material available to the individual has been in the form of written material which must be read or studied as part of a course of self-improvement. More recently such technical advances as recorded media has made available voice and visual recordings in which one may engage in the development of a positive mental attitude (PMA). Such PMA materials have been widely received by large sectors of the populace and are credited with improved success in arenas of personal human involvement such as sales, supervision, teaching and leadership.

As mentioned above, in providing for positive reinforcement with prior methods several techniques have been utilized. Most frequently, one who is in need of congratulations or encouragement often tells friends or work associates of his or her feelings and solicits a needed-pat-on-the-back. In the absence of other persons or of persons either friendly or sensitive to one's needs the individual must resort to raising their arm and hand high into the air overhead and bending the arm at the elbow to allow the hand to gently strike the upper portion of the back. This places one in a somewhat uncomfortable posture and additionally lacks the placement of a pat in the most desired middle portion of the back.

Because these methods rely on others which may be psychologically hostile or on a rather contorted physical position it is desirable to have available a more favorable means for providing a pat-on-the-back.

Accordingly, the subject invention is directed toward an apparatus useful for providing a self-administered pat-on-the-back and makes available to the individual an enjoyable and fun-to-use piece of equipment which may be used for amusement and, in addition, for desired encouragement and which provides positive reinforcement of a type unavailable previously in the above described attitude adjustment devices.

Various prior mechanical devices are known which use an arrangement of mechanical elements to apply force of contact with a person's back without the aid of another person. Such arrangements generally comprise a complicated assembly of levers, rods, axles and components to apply medicaments or special massage to the back of the user.

Another type of back contact device consists mainly of implements with which the user may reach certain parts of the back such as for relieving an annoyance, for example, an itch. Such back scratching devices are usually of a rod type shape sometimes with fingers extending from the end for applying a back and forth motion to the skin of the user's back. Still other known designs of self-administered physical contact include such devices that impart a negative behavioral attitude and tend to reduce self esteem. One such device uses a boot to kick the user in the buttocks.

The problems suggested in the preceding are not intended to be exhaustive, but rather are among many which may reduce the effectiveness and user satisfaction of prior known methods of amusement or of obtaining a positive psychological response. Other noteworthy problems may also exist; however, those presented above should be sufficient to demonstrate that positive behavior reinforcement particularly of the self-administered type appearing in the past will admit to worthwhile improvement.

In this regard, the subject invention is directed toward a back patting device providing for specific uses in the area of amusement and self-congratulation and makes available to the user self-administered pats such as are not available with the devices in the heretofore known prior art.

OBJECTS OF THE INVENTION

It is therefore a general object of the invention to provide a novel, manually operated self-congratulatory device which will obviate or minimize difficulties of the type previously described.

It is a specific object of the invention to provide a novel, easily disassembled pat-on-the-back unit which may be concealed from early discovery until it is ready for use.

It is specific object of the invention to provide a novel, light weight and attractive assemblage of rods and contoured elements for providing a manually actuated self-congratulatory response.

It is another object of the invention to provide a novel, spring biased support and arm assembly which is easily positionable from the shoulder and which automatically retracts a simulated hand from the touching position and which is restrained from uncontrolled movement and resultant unwinding of a spring biasing means by use of a rope or ribbon having a loop associated with the supporting member.

It is yet another object of the invention to provide a novel, amusement device comprising simple shapes which may be assembled quickly at the useful location and which provides fun and enjoyment and which is based on sound personal psychological development principles.

BRIEF SUMMARY OF THE PREFERRED EMBODIMENT OF THE INVENTION

One embodiment of the present invention which is intended to accomplish at least some of the above-mentioned objects comprises a self-congratulatory apparatus having an extended support member; an arm swingedly attached to the extended support member; and a means to impart motion to the arm so as to cause the arm to move in relation to the extended support member.

A preferred embodiment of the invention which is intended to accomplish at least some of the foregoing objects comprises a hinged arm which carries a hand shaped member on one end and a pivot axis on the other end. The arm is joined to the end of a rod-like support member which has a mating pivot axis. The other end of the support is received into a blind bore in a block of material contoured on one side to follow the natural curvature of the human shoulder. A short guide rod is fitted into a second blind hole located in the opposite side of the shoulder block from the first bore. A ribbon small diameter fancy rope is tied to the arm at a point just above the hand. The rope end extends to allow the user of pat-on-the-back to manually tug on the rope to actuate the hand.

To operate the device the user simply places the assembled unit on his or her shoulder and holds the guide rod with one hand to impart the desired angular relationship to the retracted simulated hand and uses the remaining free natural hand to tug on the rope and impart motion to the simulated hand to cause a pat-on-the-back to be delivered.

THE DRAWINGS

The objects and advantages of the present invention will become apparent from the following detailed description of a preferred embodiment thereof taken in conjunction with the accompanying drawings where:

FIG. 1 is a pictorial view of a manually operated selfcongratulatory apparatus of the type to advantageously utilize the subject invention; and FIG. 2 is an exploded view showing the essential and optional component parts and their relationship to each other in the subject inventive pat-on-the-back device.

DETAILED DESCRIPTION

Context of the Invention

Before presenting a detailed description of the subject self-congratulatory apparatus it may be worthwhile to briefly outline the context of the instant invention. In this connection FIG. 1 depicts the use of a manually operated back patting apparatus which may advantageously employ the self-operated shoulder supported pat-on-the-back mechanism of the subject invention.

The self-congratulatory apparatus indicated generally at 10 is supported primarily during use by resting the extending support member 12 on the shoulder. Shoulder block 16 acts to receive the extending support 12 and to distribute the weight of the mechanism evenly over a broad area. A guide rod 18 shown being grasped by the right hand of the user allows a desired tilting of the device to establish the proper angular positioning of the extending support member so as to allow the arm 20 and attached simulated hand 24 to fall freely by force of gravity to a retracted position away from the users back. Along the length of the arm, an attachment 26 fixes a flexible connector 28 such as a fancy rope or ribbon to the arm for grasping in the free hand of the user. By exerting a pull or tug on the flexible connector or rope 28 the user urges the hand into contact with the back to effect a much needed pat-on-the-back for amusement or for a pyschological lift for a job well done, a goal completed or to magnify a feeling of well being.

To operate the device of the present invention, the user simply places the apparatus on either shoulder, holds the guide rod or handle 18 in one hand and tilts the handle so that the support member 12 assumes the proper angular relationship with the back. The user then grasps the rope or ribbon connection 28 with the free hand and gives the rope a gentle pull until the back receives a gentle pat with simulated hand 24 or a more firm pat should that be desirable. Then by either releasing the rope or by moving the hand holding the rope so the rope slackens, the hand and arm retract by force of gravity to assume a ready position for a succeeding stroke.

Turning now to the remaining drawing, FIG. 2, there will be seen an illustrative embodiment of the subject inventive self-congratulatory apparatus wherein an exploded view of the arrangement of the component parts is presented.

It should be noted that the extending support member 12 which is shown as a rod may be made from a wooden dowel rod about ½ inch in diameter and about 12 inches long. An arm 20 is pivotally joined to the extending support member at a pivot 22 located at the ends of the support member and the arm. Here two pivot support blocks 32 and 34 residing at the ends of the support member 12 and the arm 20 respectively are provided with mutually aligned bore holes 54 for receiving a long screw connector 36 having an expanded head 40 and receives a cap nut retainer 38. Located at the opposite end of the arm which is also conveniently made of ½ inch dowel rod about 16 inches long is a flat planar simulated hand 24 which may be cut with a jig saw from a blank of 2/4 inch stock and provided with digits 56 of a shape so as to call to mind the fingers on a human hand. The hand 24 may be conveniently provided with a blind bore 42 in the palm termination edge for fittingly receiving the rod 20 forming the arm. A flexible connector 28 such as fancy rope, cord string or ribbon is attached to the arm 20 by tying a simple knot around the cylindrical shaft 20 or by an attachment 26 which may comprise a through bored hole in the rod to locate the connector at a fixed point on the rod or by a screw-in eyelet for tying or otherwise fixing the connector to the arm.

A shoulder block 16 having a contoured lower surface 30 for comfortable placement onto a human shoulder is provided with a blind bore 44 on the upper surface 58 opposite the contour 30 and the bore is angled at about 135 degrees with the upper surface 58 to give the necessary rise and run relationship to the upwardly extending support member 12. A second blind bore (not shown on the drawing) is provided in the front face of the shoulder block for receiving a guide rod 18 useful in steadying the apparatus when in use. Here the bore is angled with regard to the upper surface 58 so as to allow the guide rod to extend in a downward manner making it easy to grasp with the user's hand. The shoulder block is made of stock material about 1½ inches thick and all edges are preferably rounded.

In an optional arrangement the extending support member 12 is made longer, for example 30 inches and the shoulder block is not used at all. Here the support member 12 is permitted to rest on the user's shoulder with the free end of the support member acting as a guide rod or handled. Alternatively, a shoulder block 16 may be employed having a single bore hole through the block for passage therethrough of the support member obviating the second blind bore and the guide rod. In any of the above arrangements a handle having a grip or cross bar as an addition to or an extension of the guide rod or support member as the case may be is contemplated as being a handy addition.

With the exception of the metal screw connection 36 and associated capnut retainer 38 all parts of the rigid structure may be made of soft wood materials. The rods and bores are preferably are sized such that a slight interference fit is produced so as to make assembly and disassembly practical yet produce a rigid structure that remains structurally integral during use. Of course, the connector shown as screw 36 may be simply a wooden peg with split and expanded ends or another attachment configuration of the type known to those skilled in the art. It is of course also practical to consider other materials for manufacture for the entire apparatus such as modern polymer plastics. Also within the metes and bounds of the present invention is a permanent attachment of the structural elements.

In another variation the support member 12 and the arm 20 may be directly connected without the aid of pivot block 32 for the support member and the pivot block 34 for the arm. In this arrangement the ends of the dowel rods are simply bored or drilled with matching, aligned holes for attachment by means of a connector such as a screw 36 used with a retainer such as a capnut 38.

The pivot blocks 32 and 34 are conveniently made from wooden blocks which are 1 inch by 1 inch by two inches. In an optional arrangement shown in FIG. 2, a circular torsion spring 46 resides between the two blocks 32 and 34 and has a retaining hook 60 formed on each of the free ends of the spring. The retaining hook 60 is received into corresponding torsion spring retaining holes 48 (only one shown) residing in the facing surfaces of the pivot blocks 32 and 34. This spring resiliently biases the pivot blocks and the support member and arm to cause them to tend to separate toward a right angle.

In still another optional arrangement, a modified flexible connection 28 attaches to both the swing arm 20 and to the extended support member 12. Here a small circular loop 50 resides on a second rope or cord 52 being of short length. The loop 50 encircles the rod member 12 and the secondary connector cord 52 is joined to the primary rope connector 28. Such an arrangement provides a tensioner for the torsion spring arrangement and the length of the secondary cord is selected such that the arm is restrained from straightening out yet sufficient slack is available to satisfactorily operate the arm to cause contact of the hand with the back of the user.

In each of the foregoing embodiments it can be seen that a simple yet entertaining and amusing arrangement of readily available components has been assembled into an inventive combination of useful proportion. Further, such an apparatus is easy to operate to provide a needed pat-on-the-back for a job well done or a psychological lift.

SUMMARY OF MAJOR ADVANTAGES OF THE INVENTION

After reading and understanding the foregoing description of the invention, in conjunction with the drawings, it will be appreciated that several advantages of the subject self-congratulatory apparatus are obtained.

Without attempting to set forth all of the desirable features of the back patting arrangement, at least some of the major advantages of the invention include a physical embodiment useful in providing entertainment pleasure either individually or for a group of individuals. In this regard, the present invention may be utilized for amusement as a "gag gift", party favor and the like.

In addition, the present invention can be utilized to promote feelings of well being necessary to a positive mental attitude. Such an arrangment may provide the needed psychological lift to allow a person to overcome some of the "valleys" of emotional life in a highly technicalized society that often postpones the level of immediate personal approval desirable for continued accomplishment.

One such situation in which the pat-on-the-back may be of value to the user as a needed immediate approval response is that of body weight control in which the dieter may find joy and encouragement in a congratulatory act for having a low calorie meal or avoiding a dessert bar. Another such situation may present itself for tobacco smokers who have a need for immediate reward which has previously been fulfilled by a cigarette or such after the accomplishment of some task or completion of some physical activity.

The inventive unit is easily disassembled and reassembled both for transport and for concealment from early discovery until ready for use. This adds to the amusement value. The light weight and attractive assemblage of rods and contoured, soft edged elements contribute to ease of use.

Another advantage presented resides in the optional provision of a torsion spring and retaining loop to cause the assembly to assume a normally retracted position ready to be positioned upon the user's shoulder and brought into action to deliver a pat-on-the-back.

In describing the invention, reference has been made to a preferred embodiment and illustrative advantages of the invention. Those skilled in the art, however, and familiar with the instant disclosure of the subject invention, may recognize additions, deletion, modifications, substitutions and/or other changes which will fall within the purview of the subject invention and claims.

What is claimed is:

1. A self-congratulatory apparatus comprising:

a shoulder block having an upper and lower surface and a front end and a back end, said lower surface of said shoulder block being contoured to be received by a shoulder of a person utilizing said apparatus;

said upper surface of said shoulder block containing a first attachment means for receiving said first support member, said attachment means being positioned at an angle with respect to said shoulder block, and said front end of said shoulder block containing a second attachment means for receiving a second support member;

said first support member having a first end and a second end, said first end of said first support member being fixedly attached to said first attachment means of said shoulder block, said first support member extending from said shoulder block in an upwardly direction away from and behind the back side of said shoulder block such that said second end of said first support member is located in a position vertically higher than said upper surface of said shoulder block and horizontally displaced behind the back side of said shoulder block;

a second support member having a first end and a second end, said first end being fixedly attached to said second attachment means of said shoulder block, and said second support member extending outwardly from said front side of said shoulder block;

a pivot member having a first connecting means and a second connecting means, said first and second connecting means being pivotible with respect to each other, and said pivot member being fixedly attached to said first support member by said first connecting means of said pivot member;

a third support member having a first end and a second end, said first end of said third support member being fixedly attached to said second connecting means of said pivot member, and said third support member extending in a direction downwardly from said pivot member, such that said second end of said third support member is positioned vertically lower than said first end of said third support member, and said third support member being pivotable with respect to said first support member;

a simulated hand member fixedly attached to said second end of said third support member and extending downwardly therefrom, said simulated hand being pivotable with respect to said first support member; and a flexible connection means having a first end and a second end, said first end being attached to said third support member and said flexible connection means extending therefrom such that in operation said flexible connection means may be drawn in a direction in front of said person utilizing said apparatus such that said simulated hand contacts the back of said person.

2. A self-congratulatory apparatus comprising:

a shoulder block having an upper and lower surface and a front end and a back end, said lower surface of said shoulder block being contoured to be received by a shoulder of a person utilizing said apparatus;

said upper surface of said shoulder block containing a first bore extending to the interior of said shoulder block for receiving a first support member, said bore being positioned in said shoulder block at an angle such that said bore extends from said interior to the upper surface of said shoulder block in a direction toward the back end of the shoulder block, and said front end of said shoulder block cotaining a second bore extending from said interior of said shoulder block to the surface of said front end for receiving a second support member;

a first support member having a first end and a second end, said first end of said first support member being located within said first bore of said shoulder block and fixedly positioned with respect thereto, said first support extending from said shoulder block in an upwardly direction away from and behind the back side of said shoulder block such that said second end of said first support member is located in a position vertically higher than said upper surface of said shoulder block and horizontally displaced behind the back side of said shoulder block;

a second support member having a first end and a second end, said first end being positioned within said second bore of said shoulder block and fixedly positioned with respect thereto, and said second support member extending outwardly from said front side of said shoulder block;

a pivot member having a first connecting means and a second connecting means, said first and second connecting means being pivotable with respect to each other, and said pivot member being fixedly attached to said first support member by said first connecting means of said pivot member;

a third support member having a first end and a second end, said first end of said third support member being fixedly attached to said second connecting means of said pivot member, and said third support member extending in a direction downwardly from said pivot member, such that said second end of said third support member is positioned vertically lower than said first end of said third support member, and said third support member being pivotable with respect to said first support member;

a simulated hand member fixedly attached to said second end of said third support member and extending downwardly therefrom, said simulated hand being pivotable with respect to said first support member, and a flexible connection means having a first end and a second end, said first end being attached to said third support member and said flexible connection means extending therefrom such that in operation said flexible connection means may be drawn in a direction in front of said person utilizing said apparatus such that said simulated hand contacts the back of said person.

3. The apparatus of claims 1 or 2 wherein:

said second support member extends from said shoulder block in a downwardly and outwardly direction from said front side of said shoulder block.

4. The apparatus of claims 1 or 2 wherein:

said pivot member comprises a first pivot block and a second pivot block, each of said pivot blocks comprising an upper and lower surface;

said first pivot block containing a third bore extending from the interior of said first pivot block to the lower surface for receiving said second end of said first support member;

said second pivot block containing a fourth bore extending from the interior of said second pivot block to the lower surface for receiving said first end of said third support member; and a pin pivotably connecting said first pivot block to said second pivot block.

* * * * *